United States Patent [19]

McAulay et al.

[11] Patent Number: 5,054,072

[45] Date of Patent: Oct. 1, 1991

[54] CODING OF ACOUSTIC WAVEFORMS

[75] Inventors: Robert J. McAulay, Lexington; Thomas F. Quatieri, Jr., Arlington, both of Mass.

[73] Assignee: Massachusetts Institute of Technology, Cambridge, Mass.

[21] Appl. No.: 456,183

[22] Filed: Dec. 15, 1989

Related U.S. Application Data

[63] Continuation of Ser. No. 34,097, Apr. 2, 1987, abandoned.

[51] Int. Cl.[5] ..... G10L 7/06; G10L 9/18

[52] U.S. Cl. ..... 381/31; 381/38

[58] Field of Search ..... 364/513.5; 381/29-49

[56] References Cited

U.S. PATENT DOCUMENTS

| | | | |
|---|---|---|---|
| 3,360,610 | 12/1967 | Flanagan | 381/37 |
| 3,697,699 | 10/1972 | Gluth et al. | 381/51 |
| 3,978,287 | 8/1976 | Fletcher et al. | 381/41 |
| 4,034,160 | 7/1977 | Van Gerwen | 381/33 |
| 4,058,676 | 11/1977 | Wilkes et al. | 381/37 |
| 4,076,958 | 2/1978 | Fulghum | 381/51 |
| 4,696,038 | 9/1987 | Doddington et al. | 381/38 |
| 4,731,846 | 3/1988 | Secrest et al. | 381/49 |

OTHER PUBLICATIONS

Kroon and Deprettere, "Experimental Evaluation of Different Approaches to the Multi-Pulse Coder", IEEE International Conf. on ASSP, Mar. 19-21, 1984, pp. 10.4.1-10.4.4.

Holmes et al., *IEE PROC.*, vol. 127, PT. F, No. 1, "The JSRU Channel Vocoder", Feb. 1980, pp. 53-60.

Hedelin, *IEEE*, "A Tone-Oriented Voice-Excited", pp. 205-208 (1981).

Hedelin, "A Representation of Speech with Partials", pp. 247-250, *The Representation of Speech in the Peripheral Auditory System* (Carlson and Granstrom, Ed. Elsevier Press, 1982).

Quatieri et al., ICASSP 85, IEEE Proc., vol. 2, "Speech Transformations Based on a Sinusoidal Representation", Mar. 26-29, pp. 489-492.

*Primary Examiner*—Dale M. Shaw

*Assistant Examiner*—David D. Knepper

*Attorney, Agent, or Firm*—Thomas J. Engellenner

[57] ABSTRACT

Encoding techniques and devices are based on a sinusoidal speech representation model. In one aspect of the invention, a pitch-adaptive channel encoding technique for amplitude coding varies the channel spacing in accordance with the pitch of the speaker's voice. In another aspect of the invention, a phase synthesis technique locks rapidly-varying phases into synchrony with the phase of the fundamental. Phase coding techniques which introduce a voice-dependent random phase and a pitch-adaptive quadratic phase dispersion are also performed.

23 Claims, 4 Drawing Sheets

CODING OF ACOUSTIC WAVEFORMS

The U.S. Government has rights in this invention pursuant to the Department of the Air Force Contract No. F19628-85-C-0002.

REFERENCE TO RELATED APPLICATION

This application is a continuation of application Ser. No. 034,097, filed Apr. 2, 1987, now abandoned, which is a continuation-in-part of U.S. Ser. No. 712,866 "Processing of Acoustic Waveforms" filed Mar. 18, 1985, now abandoned.

BACKGROUND OF THE INVENTION

The field of this invention is speech technology generally and, in particular, methods and devices for analyzing, digitally-encoding, modifying and synthesizing speech or other acoustic waveforms.

Digital speech coding methods and devices are the subject of considerable present interest, particularly at rates compatible with conventional transmission lines (i.e., 2.4–9.6 kilobits per second). At such rates, the typical approaches to speech modeling, such as the so-called "binary excitation models", are ill-suited for coding applications and, even with linear predictive coding or other state of the art coding techniques, yield poor quality speech transmissions.

In the binary excitation models, speech is viewed as the result of passing a glottal excitation waveform through a time-varying linear filter that models the resonant characteristics of the vocal tract. It is assumed that the glottal excitation can be in one of two possible states corresponding to voiced or unvoiced speech. In the voiced speech state the excitation is periodic with a period which varies slowly over time. In the unvoiced speech state, the glottal excitation is modeled as random noise with a flat spectrum.

The above-referenced parent application, U.S. Ser. No. 712,866 discloses an alternative to the binary excitation model in which speech analysis and synthesis as well as coding can be accomplished simply and effectively by employing a time-frequency representation of the speech waveform which is independent of the speech state. Specifically, a sinusoidal model for the speech waveform is used to develop a new analysis-synthesis technique.

The basic method of U.S. Ser. No. 712,866 includes the steps of; (a) selecting frames (i.e. windows of about 20–40 milliseconds) of samples from the waveform; (b) analyzing each frame of samples to extract a set of frequency components; (c) tracking the components from one frame to the next; and (d) interpolating the values of the components from one frame to the next to obtain a parametric representation of the waveform. A synthetic waveform can then be constructed by generating a set of sine waves corresponding to the parametric representation. The disclosures of U.S. Ser. No. 712,866 are incorporated herein by reference.

In one illustrated embodiment described in detail in U.S. Ser. No. 712,866, the method is employed to choose amplitudes, frequencies, and phases corresponding to the largest peaks in a periodogram of the measured signal, independently of the speech state. In order to reconstruct the speech waveform, the amplitudes, frequencies, and phases of the sine waves estimated on one frame are matched and allowed to continuously evolve into the corresponding parameter set on the successive frame. Because the number of estimated peaks is not constant and is slowly varying, the matching process is not straightforward. Rapidly varying regions of speech such as unvoiced/voiced transitions can result in large changes in both the location and number of peaks. To account for such rapid movements in spectral energy, the concept of "birth" and "death" of sinusoidal components is employed in a nearest-neighbor matching method based on the frequencies estimated on each frame. If a new peak appears, a "birth" is said to occur and a new track is initiated. If an old peak is not matched, a "death" is said to occur and the corresponding track is allowed to decay to zero. Once the parameters on successive frames have been matched, phase continuity of each sinusoidal component is ensured by unwrapping the phase. In one preferred embodiment the phase is unwrapped using a cubic phase interpolation function having parameter values that are chosen to satisfy the measured phase and frequency constraints at the frame boundaries while maintaining maximal smoothness over the frame duration. Finally, the corresponding sinusoidal amplitudes are simply interpolated in a linear manner across each frame.

In speech coding applications, U.S. Ser. No. 712,866 teaches that pitch estimates can be used to establish a set of harmonic frequency bins to which the frequency components are assigned. (Pitch is used herein to mean the fundamental rate at which a speaker's vocal cords are vibrating). The amplitudes of the components are coded directly using adaptive differential pulse code modulation (ADPCM) across frequency or indirectly using linear predictive coding. In each harmonic frequency bin, the peak having the largest amplitude is selected and assigned to the frequency at the center of the bin. This results in a harmonic series based upon the coded pitch period. The phases are then coded by using the frequencies to predict phase at the end of the frame, unwrapping the measured phase with respect to this prediction and then coding the phase residual using 4–5 bits per phase peak.

At low data rates (i.e., 4.8 kilobits per second or less), there can sometimes be insufficient bits to code amplitude information, especially for low-pitched speakers using the above-described techniques. Similarly, at low data rates, there can be insufficient bits available to code all the phase information. There exists a need for better methods and devices for coding acoustic waveforms, particularly for coding speech at low data rates.

SUMMARY OF THE INVENTION

New encoding techniques based on a sinusoidal speech representation model are disclosed. In one aspect of the invention, a pitch-adaptive channel encoding technique for amplitude coding is disclosed in which the channel spacing is varied in accordance with the pitch of the speaker's voice. In another aspect of the invention, a phase synthesis technique is disclosed which locks rapidly-varying phases into synchrony with the phase of the fundamental.

Since the parameters of the sinusoidal model are the amplitudes, frequencies and phases of the underlying sine waves, and since for a typical low-pitched speaker there can be as many as 80 sine waves in a 4 kHz speech bandwidth, it is not possible to code all of the parameters directly and achieve transmission rates below 9.6 kbps.

The first step in reducing the size of the parameter set to be coded is to employ a pitch extraction algorithm which lead to a harmonic set of sine waves that are a "perceptual" best fit to the measured sine waves. With this strategy, coding of individual sine-wave frequencies is avoided. A new set of sine-wave amplitudes and phases is then obtained by sampling an amplitude and phase envelope at the pitch harmonics. Efficiencies are gained in coding the amplitudes by exploiting the correlation that exists between the amplitudes of neighboring sine waves. A predictive model for the phases of the sine waves is also developed, which not only leads to a set of residual phases whose dynamic ranges are a fraction of the $[-\pi,\pi]$ extent of the measured phases, but also leads to a model from which the phases of the high frequency sine waves can be regenerated from the set of coded baseband phases. Depending on the number of bits allowed for the amplitudes and the number of baseband phases that are coded, very natural and intelligible coded speech is obtained at 8.0 kbps.

Techniques are also disclosed herein for encoding the amplitudes and phases that allow the Sinusoidal Transform Coder (STC) to operate at a rate down to 1.8 kbps. The notable features of the resulting class of coders is the intelligibility and the naturalness of the synthetic speech, the preservation of speaker-identification qualities so that talkers were easily recognizable, and the robustness in a background of high ambient noise.

In addition to using differential pulse code modulation (DPCM) to exploit the amplitude correlation between neighboring channels, further efficiencies are gained by allowing the channel separation to increase logarithmically with frequency (at least for low-pitched speakers), thereby exploiting the critical band properties of the ear. In one preferred embodiment, a set of linearly-spaced frequencies in the baseband and a further set of logarithmically-spaced frequencies in the higher frequency region are employed in the transmitter to code amplitudes. At the receiver, another amplitude envelope is constructed by linearly interpolating between the channel amplitudes. This is then sampled at the pitch harmonics to produce the set of sine-wave amplitudes to be used for synthesis.

For steadily voiced speech, the system phase can be predicted from the coded log-amplitude using homomorphic techniques which when combined with a prediction of the excitation phase can restore complete fidelity during synthesis by merely coding phase residuals. During unvoiced, transitions and mixed excitation, phase predictions are poor, but the same sort of behavior can be simulated by replacing each residual phase by a uniformly-distributed random variable whose standard deviation is proportional to the degree to which the analyzed speech is unvoiced.

Moreover, for a very low data rate transmission lines (i.e., below 4.8 kbps), a coding scheme has been devised that essentially eliminates the need to code phase information. In order to avoid the loss in quality and naturalness which would otherwise occur in a "magnitude-only" analysis/synthesis system, systems are disclosed herein for maintaining phase coherence and introducting an artificial phase dispersion. A synthetic phase model is disclosed which phase-locks all the sine waves to the fundamental and adds a pitch-dependent quadratic phase dispersion and a voicing-dependent random phase to each phase track.

Speech is analyzed herein as having two components to the phase: a rapidly-varying component that changes with every sample and a slowly varying component that changes with every frame. The rapidly-varying phases are locked into synchrony with the phase of the fundamental and, furthermore, the pitch onset time simply establishes the time at which all the excitation sine waves come into phase. Since rapidly-varying phases will be multiples of the phase of the fundamental.

The invention will next be described in connection with certain illustrated embodiments. However, it should be clear that various changes and modifications can be made by those skilled in the art without departing from the spirit and scope of the invention. For example, although the description that follows is particularly adapted to speech coding, it should be clear that various other acoustic waveforms can be processed in a similar fashion.

DETAILED DESCRIPTION

In the present invention, the speech waveform is modeled as a sum of sine waves. Accordingly, the first step in coding speech is to express the input speech waveform, s(n), in terms of the sinusoidal model, $$s(n) = \sum_{k=1}^{K} A_k \exp j(n\omega_k + \theta_k) \tag{1}$$

where $A_k$, $\omega_k$ and $\theta_k$ are the amplitudes, frequencies and phases corresponding to the peaks of the magnitude of the high-resolution short-time Fourier transform. It should be noted that the measured frequencies will not in general be harmonic. The speech waveform can be modeled as the result of passing a glottal excitation waveform through a vocal tract filter. If $H(\omega)$ represents the transfer characteristics of this filter, then the glottal excitation waveform e(n) can be express as $$e(n) = \sum_{k=1}^{K} a_k \exp[j(n\omega_k + \phi_k)] \tag{2}$$

where $$a_k = A_k / |H(\omega_k)| \tag{3a}$$

$$\phi_k = \theta_k - \arg H(\omega_k). \tag{3b}$$

In order to calculate the excitation phase in (3b), it is necessary to compute the amplitude and phase of the vocal tract filter. This can be done either by using homomorphic techniques or by fitting an all-pole model to the measured sine-wave amplitudes. These techniques are discussed in U.S. Ser. No. 712,866. Both of these methods yield an estimate of the vocal tract phase that is inherently ambiguous since the same transfer characteristic is obtained for the waveform −s(n) as is obtained for s(n). This essential ambiguity is accounted for in the excitation model by writing $$\phi_k=\theta_k-arg\ H(\omega_k)-\beta\pi \quad (4)$$

where $\beta$is either 0 or 1, a decision that must be accounted for in the analysis procedure.

Figure 1:
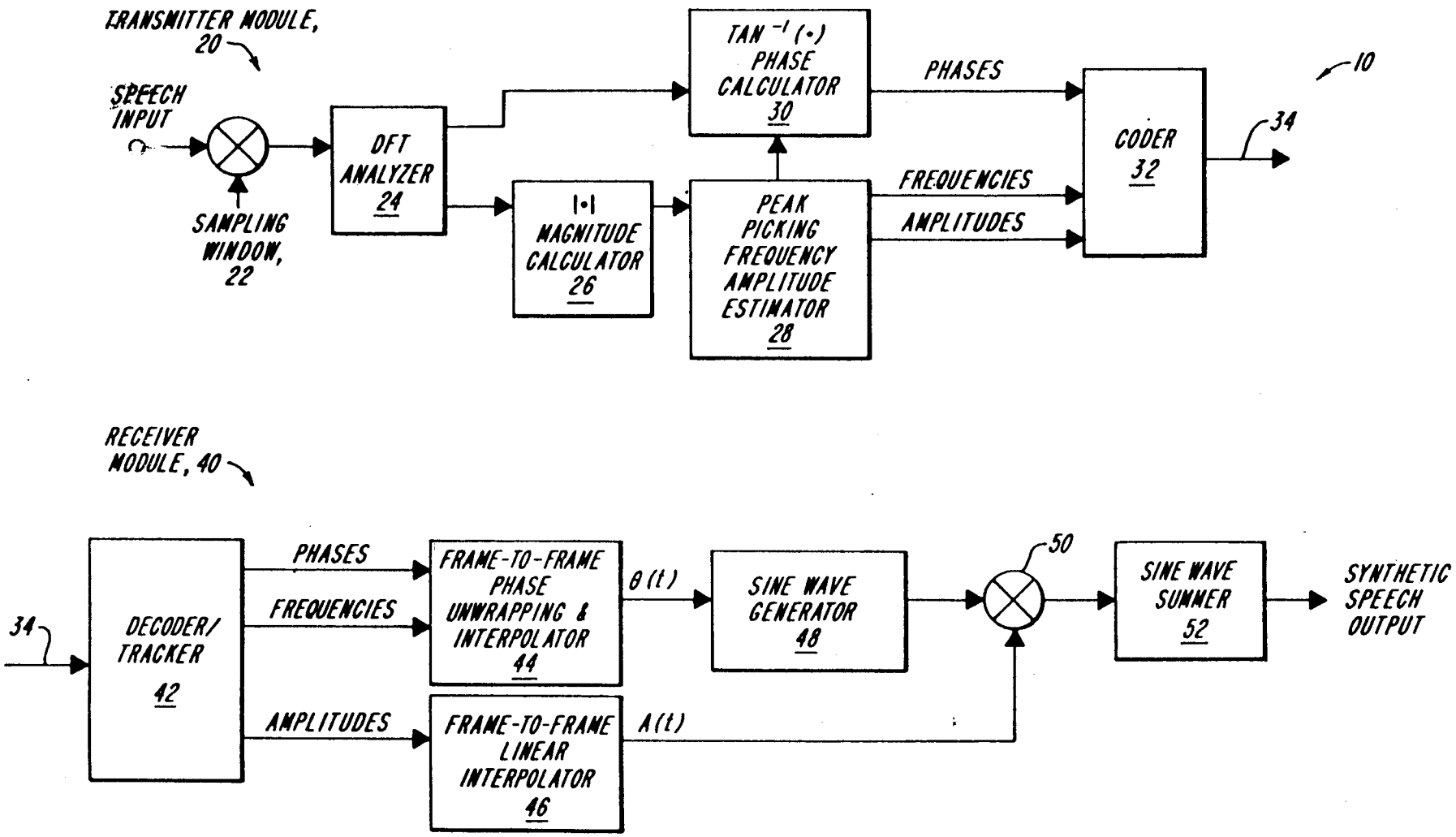
FIG. 1 is a schematic block diagram of the invention.

FIG. 1 is a block diagram showing the basic analysis/synthesis system of the present invention. As shown in FIG. 1, system 10 comprises a transmitter module 20, including sampling window 22, discrete Fourier transform analyzer 24, magnitude calculator 26, frequency amplitude estimator 28, phase calculator 30 and a coder 32 (which yields channelled signals 34 for transmission); and a receiver module 40 (which receives the channel signals 34), including a decoder/tracker 42, phase interpolator 44, amplitude interpolator 46, sine wave generator 48, modulator 50 and summer 52. The peaks of the magnitude of the discrete Fourier transform (DFT) of a windowed waveform are found simply by determining the locations of a change in slope (concave down). Phase measurements are derived from the discrete Fourier transform by computing the arctangents at the estimated frequency peaks.

In a simple embodiment, the speech waveform can be digitized at a 10 kHz sampling rate, low filtered at 5 kHz, and analyzed at 10–20 msec frame intervals employing an analysis window of variable duration in which the width of the analysis window is pitched adaptive, being set, for example, at 2.5 times the average pitch period with a minimum width of 20 msec.

Pitch-Adaptive Amplitude Coding

The earlier versions of the sinusoidal transform coder (STC) exploited the correlation that exists between neighboring sine waves by using PCM to encode the differential log-amplitudes. Since a fixed number of bits were allocated to the amplitude coding, then the number of bits per amplitude was allowed to change as the pitch changed. Since for low-pitched speakers there can be as many as 80 sine waves in a 4000 Hz speech bandwidth, then at 8.0 kbps at least 1 bit can be allocated for each differential amplitude, while leaving 4000 bits/sec for coding the pitch, energy, and about 12 baseband phases. At 4.8 kbps, assigning 1 bit/amplitude immediately exhausts the coding budget so that no phases can be coded. Therefore, a more efficient amplitude encoder is needed for operation at the lower rates.

It has been discovered that natural speech of good quality can be obtained if about 7 baseband phases are coded. Using the predictive phase model, it has also been determined that 4 bits/phase is sufficient, provided a non-linear quantization rule was used in which the quantum step size increased as that residual phase got closer to the $\pm\pi$ boundaries. After allowing for coding of the pitch, energy and the parameters of the phase model, 50 bits remained for coding the amplitudes (when a 50 Hz. frame rate is used).

One way to encode amplitude information at low rates is to exploit a perception-based strategy. In addition to using the DPCM technique to exploit the amplitude correlation between neighboring channels, further efficiencies are gained by allowing the channel separation to increase logarithmically with frequency, thereby exploiting the critical band properties for the ear. This can be done by constructing an envelope of the sine-wave amplitudes by linearly interpolating between sine-wave peaks. This envelope is then sampled at predefined frequencies. A 22-channel design was developed which allowed for 9 linearly-spaced frequencies at 93 Hz/channel in the baseband and 11 logarithmically-spaced frequencies in the higher-frequency region. DPCM coding was used with 3 bits/channel for the channels 2 to 9 and 2 bits/channel for channels 10 to 22. It is not necessary to explicitly code channel 1 since its level is chosen to obtain the desired energy level.

At the receiver, another amplitude envelope is constructed by linearly interpolating between the channel amplitudes. This is then sampled at the pitch harmonics to produce the set of sine-wave amplitudes to be used for synthesis.

While this strategy may be a reasonable design technique for speakers whose pitch is below 93 Hz, it is obviously inefficient for high-pitched speakers. For example, if the pitch is above 174 Hz, then there are at most 22 sine waves, and these could have been coded directly. Based on this idea, the design was modified to allow for increased channel spacing whenever the pitch was above 93 Hz. If $F_O$ is the pitch and there are to be M linearly-spaced channels out of a total of N channels, then the linear baseband ends at frequency $F_M=MF_O$. The spacing of the (N-M) remaining channels increases logarithmically such that $$F_n=(1+\alpha)F_{n-1},\ n=M+1,\ M+2,\ \ldots,\ N \quad (5)$$

The expansion factor $\alpha$ is chosen such that $F_N$is close to the 4000 Hz band edge. If the pitch is at or below 93 Hz, then the fixed 93 Hz linear/logarithmic design can be used, and if it is above 93 Hz, then the pitch-adaptive linear/log design can be used. Furthermore, if the pitch is above 174 Hz, then a strictly linear design can be used. In addition, the bit allocation per channel can be pitch-adaptive to make efficient use of all of the available bits.

The DPCM encoder is then applied to the logarithm of the envelope samples at the pitch-adaptive channel frequencies. Since the quantization noise has essentially a flat spectrum in the quefrequency domain (the Fourier transform of the log magnitudes) and since the speech envelope spectrum varies as $1/n^2$ in this domain, then optimal reduction of the quantization noise is possible by designing a Weiner filter. This can be approximated by an appropriately designed cepstral low-pass filter.

This amplitude encoding algorithm was implemented on a real-time facility and evaluated using the Diagnostic Rhyme Test. For 3 male speakers, the average scores were 95.2 in the quiet, 92.5 in airborne-cofnmand-post noise and 92.2 in office noise. For females, the scores were about 2 DRT points lower in each case.

Although the pitch-adaptive 22-channel amplitude encoder is designed for operation at 4.8 kbps, it can operate at any rate from 1.8 kbps to 8.0 kbps simply by changing the bit allocations for the amplitudes and phases. Operation at rates below 4.8 kbps was most easily obtained by eliminating the phase coding. This effectively defaulted the coder into a "magnitude-only" analysis/synthesis system whereby the phase tracks are obtained simply by integrating the instantaneous frequencies associated with each of the sine waves. In this way, operation at 3.1 kbps was achieved without any modification to the amplitude encoder. By further reducing the bit allocations for each channel, operation at rates down to 1.8 kbps was possible. While all of the low rate systems appear to be quite intelligible, serious artifacts could be heard in the 1.8 kbps system, since in this case only 1 bit/channel was being used. At 2.4 kbps, these artifacts were essentially removed, and at 3.1 kbps, the synthetic speech was very smooth and completely free of artifacts. However, the quality of the synthetic speech at these lower rates was judged by a number of listeners to be "reverberant," "strident," and "mechanical".

In fact, the same loss in quality and naturalness appear to occur in the uncoded magnitude-only system. It was hypothesized that a major factor in this loss of quality was lack of phase coherence in the sine waves. Therefore, if high quality speech is desired at rates below 4.8 kbps using the STC system, then provision can be made for maintaining phase coherence between neighboring sine waves. An approach for achieving this phase coherence is discussed below.

Phase Modeling

The goal of phase modeling is to develop a parametric model to describe the phase measurements in (4). The intuition behind the new phase model stems from the fact that during steady voicing the excitation waveform will consist of a sequence of pitch pulses. In the context of the sinewave model, a pitch pulse occurs when all of the sine waves add coherently (i.e., are in phase). This means that the glottal excitation waveform can be modeled as $$\hat{e}(n) = \sum_{k=1}^{K} a_k \exp[j(n - n_o)\omega_k] \tag{6}$$

where $n_o$ is the onset time of the pitch pulse measured with respect to the center of the analysis frame. This shows that the excitation phases depend linearly on frequency. The phase model depends on the two parameters, $n_o$ and $\beta$ which should be chosen to make e(n) "close to" e(n). Since the amplitudes of the excitation sine waves are more or less flat, a good criterion to use is the minimum mean-squared error. Therefore, we seek the value of the onset time and the phase ambiguity which minimized the error $$\sum_{n=-N/2}^{N/2} |e(n) - \hat{e}(n)|^2 \tag{7}$$

where (N+1) is the number of points in the analysis frame. Using (2) and (6) in (7) and the fact that the analysis frame was originally chosen to be long enough to resolve all the component sine waves, then it is easy to show that the least squares estimates of the model parameters can be obtained by finding the maximum of the function $$\rho(n_o,\beta) = \sum_{k=1}^{K} a_k^2 \cos[\theta_k - \arg H(\omega_k) - \beta\pi + n_o\omega_k] \tag{8}$$

This expression can be simplified somewhat by defining the pitch onset likelihood function to be $$l(n_o) = \sum_{k=1}^{K} a_k^2 \cos[\theta_k - \arg H(\omega_k) + n_o\omega_k] \tag{9}$$

and then noting that for $\beta=0$, $\rho(n_o, 0)=l(n_o)$ whereas for $\beta=1$, $\rho(n_o, 1)=-l(n_o)$. This means that the onset time is estimated by locating the maximum of $|l(n_o)|$. If $n_o$ denotes the maximizing value, then the phase ambiguity is resolved by choosing $\beta=0$ if $l(n_o)$ is positive and $\beta=1$ if $l(n_o)$ is negative. Unfortunately, the function $l(n_o)$ is highly non-linear in $n_o$, and it is not possible to find a simple analytical solution for the optimum value.

Figure 2:
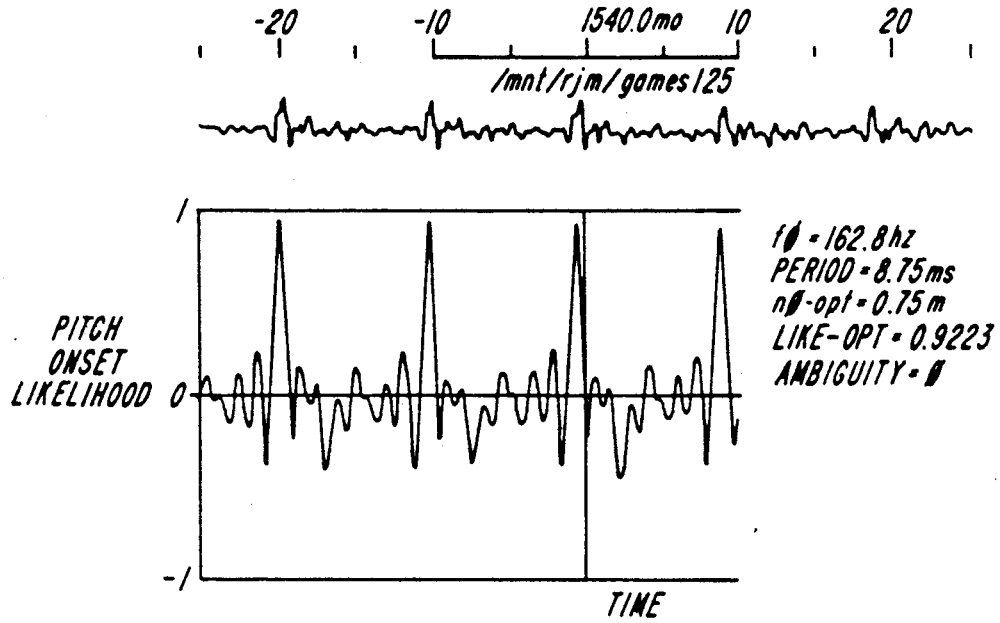
FIG. 2 is a plot of a pitch onset likelihood function according to the invention for a frame of male speech.
Figure 3:
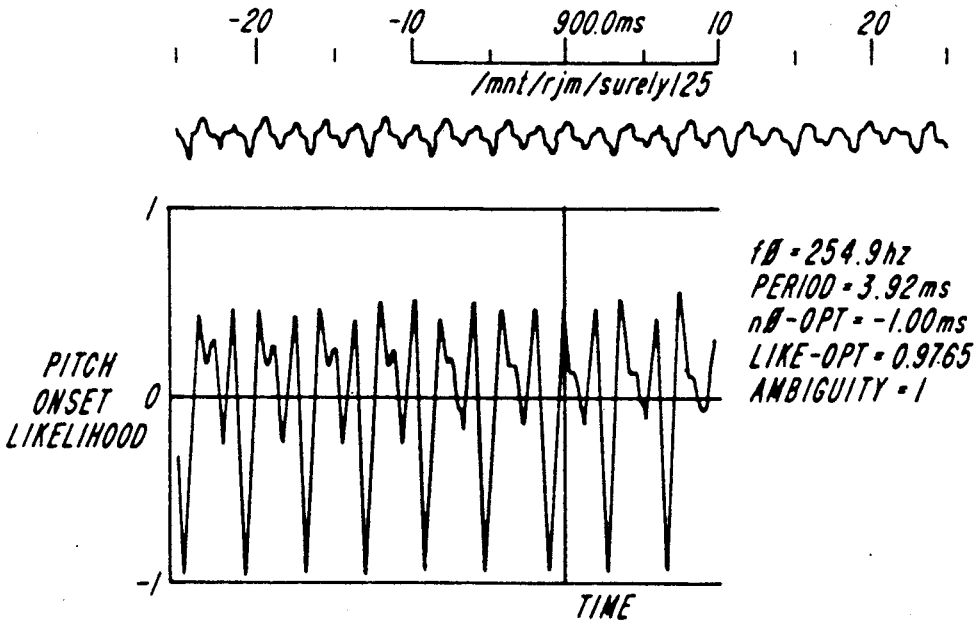
FIG. 3 is a plot of a pitch onset likelihood function according to the invention for a frame of female speech.

As a consequence, the optimizing value was found by evaluating $l(n_o)$ over a range of onset times corresponding to the largest expected pitch period (20 ms in our case). FIG. 2 illustrates a plot of the pitch onset likelihood function evaluated for a frame of male speech. The positive-ongoing peaks indicate that there is no ambiguity in the measured system phase. FIG. 3, which corresponds to a frame of female speech, shows how the inherent ambiguity in the system phase manifests itself in negative-going peaks in the likelihood function. These results, which are typical of those obtained for voiced speech, show that it is possible to estimate the onset time of the pitch pulses from the phase measurements used in the sinusoidal representation.

Figure 4:
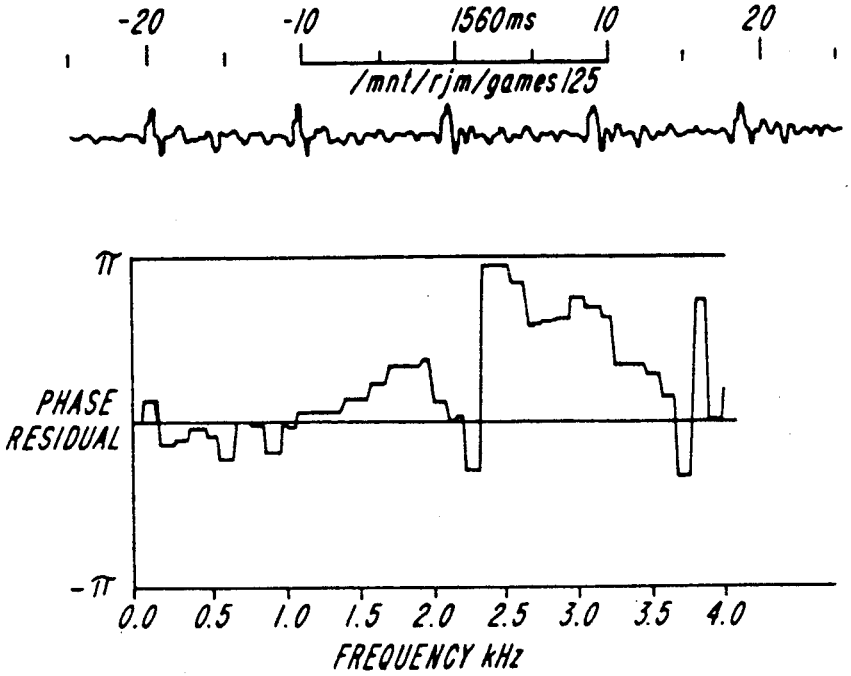
FIG. 4 is an illustration of the phase residuals suitable for coding for the sampled speech data of FIG. 2.

The first step used in coding the sine wave parameters is to assign one sine wave to each harmonic frequency bin. Since it is this set of sine wave which will ultimately be reconstructed at the receiver, it is to this reduced set of sine waves that the new phase model will be applied. In the most recent version of the STC system, an amplitude envelope is created by applying linear interpolation to the amplitudes of the reduced set of sine waves. This is used to flatten the amplitudes and then homomorphic methods are used to estimate and remove the system phase to create the sine-wave representation of the glottal excitation waveform. The onset time and the system phase ambiguity are then estimated and used to form a set of residual phases. If the model were perfect, then these phase residuals would be zero. Of course, the model is not perfect; hence, for good synthetic speech it is necessary to code the residuals. An example of such a set of residuals is shown in FIG. 4 for the same data illustrated in FIG. 2. Since only the sine waves in the baseband (up to 1000 Hz) will be coded, the model is actually fitted to the sine wave phase data only in the baseband region. The main point is that whereas the original phase measurements has values that were uniformly distributed over the $[-\pi,\pi)$ region, the dynamic range of the phase residuals is much less than $\pi$, hence, coding efficiencies can be obtained.

The final step in coding the sine wave parameters is to quantize the frequencies. This is done by quantizing the residual frequency obtained by replacing the measured frequency by the center frequency of the harmonic bin in which the sine wave lies. Because of the close relationship between the measured excitation phase of a sine wave and its frequency, it is desirable to compensate the phase should the quantized frequency be significantly different from the measured value. Since the final decoded excitation phase is the phase predicted by the model plus the coded phase residual, some phase compensation is inherent in the process since the phase model will be evaluated at the coded frequency and, hence, will better preserve the pitch structure in the synthetic waveform.

The above analysis is based on the voiced speech case. If the speech should be unvoiced, the linear model will be totally in error, and the residual phase could be expected to deviate widely about the proposed straight-line model. These deviations would be random, a property which would be captured by the phase coder, hence, preserving the essential noise-like quality of the unvoiced speech.

During steady voicing, the glottal excitation can be thought of as a sequence of periodic impulses which can be decomposed into a set of harmonic sine waves that add coherently at the time of occurrence of each pitch pulse. Based on this idea, a model for the speech waveform can be written as $$\hat{s}(n) = \sum_{m=1}^{M} A(m\omega_o)\exp[j(n - n_o)n\omega_o + \Phi(m\omega_o) + \epsilon(m\omega_o)] \tag{10}$$

where $A(\omega)$ is the amplitude envelope, $n_o$ is the pitch onset time, $\omega_o$ is the pitch frequency, $\Phi(\omega)$ is the system phase and $\epsilon(m\omega_o)$ is the residual phase at the $m^{th}$ harmonic; $\omega=2\pi f/f_s$ is the angular frequency in radians, relative to the sampling frequency $f_s$. Since under a minimum-phase assumption the system phase can be determined from the coded log-amplitude using homomorphic techniques, then the fidelity of the harmonic reconstruction depends only on the number of bits that can be assigned to the coding of the phase residuals.

Based on experiments performed during the development of the 4.8 kbps system, it was observed that during steady voicing the predictive phase model was quite accurate, resulting in phase residuals that were essentially zero, while during unvoiced speech, the phase predictions were poor resulting in phase residuals that appeared to be random values within $[-\pi,\pi]$. During transitions and mixed excitations, the behavior of the phase residuals was somewhere between these two extremes. The same sort of behavior can be simulated by replacing each residual phase by a uniformly-distributed random variable whose standard deviation is proportional to the degree to which the analyzed speech is unvoiced. If $P_v$ denotes the probability that the speech is voiced, and if $\theta_m$ is a uniformly distributed random variable on $[-\pi,\pi]$, then $$\hat{\epsilon}(m\omega_o)=\theta_m(1-P_v) \tag{11}$$

provides an estimate for the phase residual. An estimate of the voicing probability is obtained from the pitch extractor being related to the degree to which the harmonic model is fitted to the measured set of sine waves.

This model was implemented in real-time and the immediate sense was a "buzziness" in the synthetic speech. An explanation for this can be derived from the residual phase model from which it follows that during strongly-voiced speech, $P_v=1$, $\epsilon(m\omega_o)=0$, and then from (11)

$$s(n) = \sum_{m=1}^{M} A(m\omega_o)\exp j[(n - n_o)m\omega_o + \Phi(m\omega_o)] \tag{12}$$

Since the system phase $\Phi(\omega)$ is derived from the coded log-magnitude, it is minimum-phase, which causes the synthetic waveform to be "spiky" and, in turn, leads to the perceived "buzziness". Several approaches have been proposed for reducing this effect by introducing some sort of phase dispersion. For example, a dispersive filter having a flat amplitude and quadratic phase can be used, an approach which happens to be particularly well-suited to the sinusoidal synthesizer since it can be implemented simply by replacing the system phase in (10) by $$\Phi(\omega)=\beta\omega^2 \tag{13}$$

The flexibility of the STC system allows for a pitch-adaptive speaker-dependent design. This can be done by considering the group delay associated with this phase characteristic which is given by $$T(\omega) = -\frac{d\Phi(\omega)}{d\omega} = -2\beta\omega. \tag{14}$$

A reasonable design rule is to require that the chirp duration be some fraction of the average pitch period. Since $\omega=2\pi f/f_s$, then the duration of the chirp is approximately given by $T(\pi)$. Hence, if $\overline{P}_o$ represents the average pitch period, then $T(\pi)=\alpha\overline{P}_o$ leads to the design rule $$\hat{\Phi}(\omega) = \frac{\alpha}{\overline{\omega}_o}\omega^2 \tag{15}$$

where $\overline{\omega}_o=2\pi/\overline{P}_o$ is the average pitch frequency and $0<\alpha<1$ controls the length of the chirp. The synthesis model then becomes $$\hat{s}(n) = \sum_{m=1}^{M} A(m\omega_o)\exp\left\{j\left[(n - n_o)m\omega_o - \frac{\alpha}{\overline{\omega}_o}(m\omega_o)^2 + \epsilon(m\omega_o)\right]\right\} \tag{16}$$

Although derived for the voiced-speech case, the dispersive model in (16) is used during all voicing states, since during unvoiced speech the phase residuals become random variables.

For lower rate applications, it is necessary to use an even more constrained phase model. There are two components to the phase: a rapidly-varying component that changes with every sample, and a slowly-varying component that changes with every frame. The rapidly-varying component can be written as $$\phi_m(n)=(n-n_o)m\omega_o=n\phi_o(n) \tag{17}$$

where $$\phi_o(n)=(n-n_o)\omega_o. \tag{18}$$

This shows that the rapidly-varying phases are locked in synchrony with the phase of the fundamental and, furthermore, that the pitch onset time simply establishes the time at which all of the excitation sine waves come into phase. But since the sine waves are phase-locked, this onset time simply represents a delay which is not perceptible by the ear and, hence, can be ignored. Therefore, the phase of the fundamental can be generated by integrating the instantaneous pitch frequency, but now as a consequence of (10), the phase relationship between neighboring sine waves will be preserved. Therefore, the rapidly-varying phases are multiples of the phase of the fundamental, which now becomes $$\phi_o(n) = \phi_o(kN) + \int_{O}^{n-kN} \omega_o(t)dt \tag{19}$$

$$kN \leqq n \leqq (k + 1)N$$

with

-continued $$\omega_o(t) = \omega_o^k + \frac{\omega_o^{k+1} - \omega_o^k}{2} \frac{t}{N} \quad O \leqq t \leqq N \tag{20}$$

where $\omega^k_o$, $\omega^{k+1}_o$ are the measured pitch frequencies on frames k, k+1, respectively.

The resulting phase-locked synthesizer has been implemented on the real-time system and found to dramatically improve the quality of the synthetic speech. Although the improvements are most noticeable at the lower rates below 3 kbps where no phase coding is possible, the phase-locking technique can also be used for high-frequency regeneration in those cases where not all of the baseband phases are coded. In fact, very good quality can be obtained at 4.8 kbps while coding fewer phases than was used in the earlier designs. Furthermore, since Eqs. (16–20) depend only on the measured pitch frequency, $\omega_o$, and a voicing probability, $P_v$, reduction in the data rate below 4.8 kbps is not possible with less loss in quality even though no explicit phase information is coded.

Figure 5:
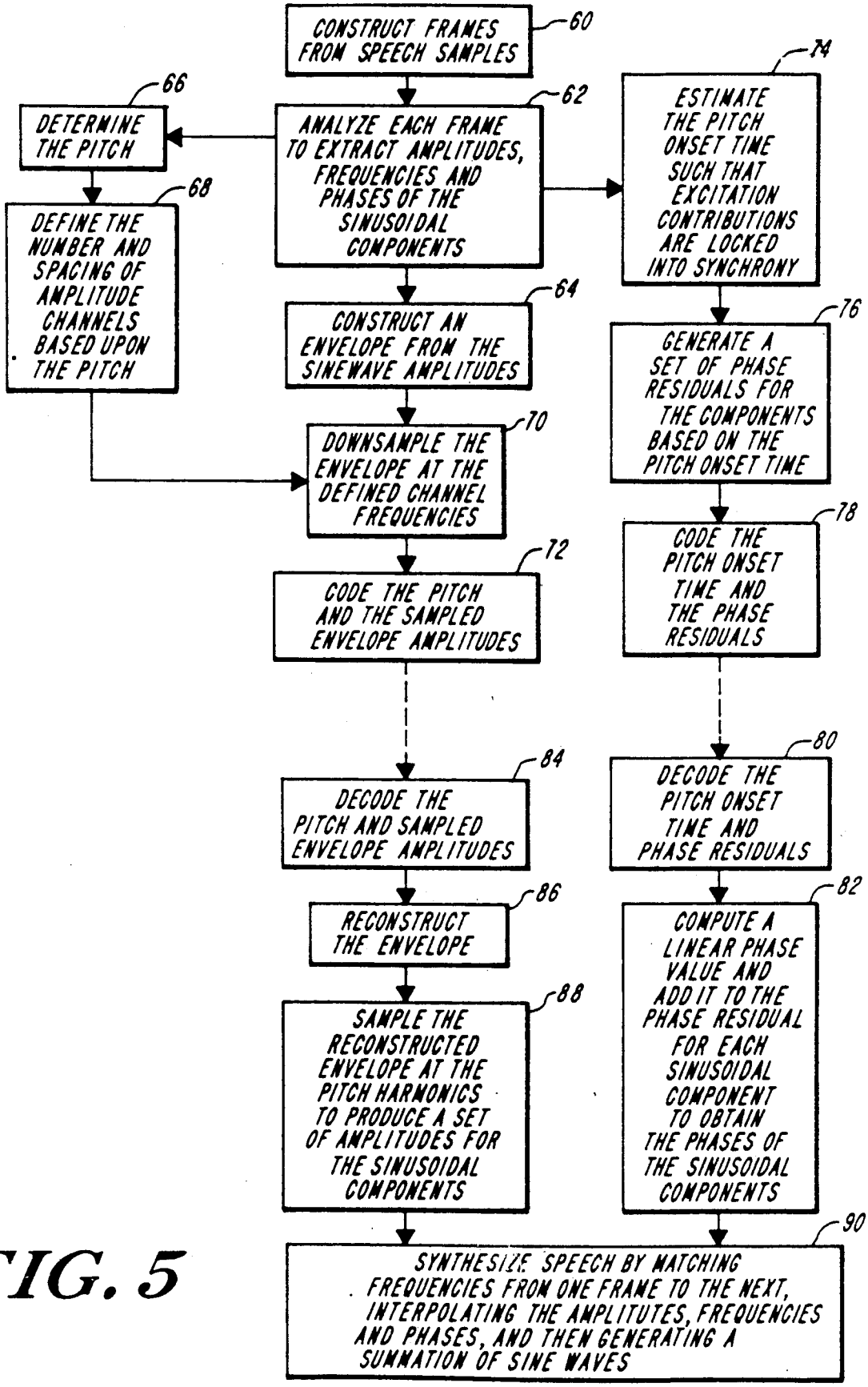
FIG. 5 is a schematic block diagram of amplitude and phase coding techniques according to the present invention.

FIG. 5 is a schematic flow chart summarizing the methods of the present invention. As shown, the method includes the steps of constructing frames from speech samples (Block 60), analyzing each frame to extract the amplitudes, frequencies and phases of the sinusoidal components (Block 62) and construction of an envelope from the sine wave amplitudes (Block 64). The pitch is determined from the analysis of each frame (Block 66), and a pitch-dependent number of amplitude channels (which can be non-linear) are defined (Block 68). The envelope is then downsampled at the defined channels frequencies (Block 70), and the sampled amplitudes, as well as the fundamental frequency (pitch) of the waveform during the analyzed frame, are coded for transmission (Block 72).

The frames analysis process (Block 62) can also be used to estimate the pitch onset time, such that the excitation components are locked into synchrony (Block 74), and a set of phase residuals for the sinusoidal components can be generated based on the pitch onset time (Block 7). These phase residuals and the pitch onset time can also be coded, if sufficient bandwidth exists (Block 78).

At the receiver, the pitch onset time and the phase residuals can be decoded (Block 80) and the phase values reconstructed by computing a linear phase value from the pitch onset time and adding it to the phase residual for each sinusoidal component (Block 82). (Alternatively, if the bandwidth of the communication channel is insufficient, the pitch onset time can be determined from the sequence of pitch periods, and the phase-residuals can be estimated from a pitch-dependent quadratic phase dispersion in conjunction with the substitution of random phase values during unvoiced speech segments.) At the same time, the pitch and the sampled envelope amplitudes are decoded (Block 84), and another amplitude envelope is constructed, for example, by linearly interpolating between channel amplitudes (Block 86). This envelope can then be sampled at the pitch harmonics to obtain the amplitudes of the sinusoidal components (Block 88). Finally, the phase, frequency and amplitude information is used to reconstruct the speech by frequency matching, interpolation of amplitude, frequency and phases for the matched components and the generation of a summation of the sine waves (Block 90).

We claim:

1. A method of coding speech for digital transmission, the method comprising:

sampling the speech to obtain a series of discrete samples and constructing therefrom a series of frames, each frame spanning a plurality of samples;

analyzing each frame of samples to extract a set of variable frequency components having individual amplitudes and phases which, in summation, approximate the waveform of the speech frame;

estimating a pitch for each frame of samples;

coding data representative of the analyzed speech frame and the pitch for digital transmission;

synthesizing a set of reconstruction frequency components from the encoded data; and establishing a pitch onset time at which the frequency components come into phase synchrony.

2. The method of claim 1 wherein the step of coding the frequency components further includes determining a pitch onset time to establish a time at which the frequency components come into phase synchrony.

3. The method of claim 1 wherein the step of analyzing each frame to extract frequency components further includes predicting the phases of the frequency components by homomorphic transformation and pitch onset time analysis, and the step of coding the frequency components includes coding only the phase residuals for transmission.

4. The method of claim 1 wherein the step of coding the frequency components further includes applying a pitch-dependent quadratic phase dispersion to the frequency components to eliminate the need to code phase values for the frequency components.

5. The method of claim 1 wherein the step of coding the frequency components further includes generating a voicing dependent random phase for said frequency components to eliminate the need to code phase values for the frequency components.

6. The method of claim 1 wherein the step of analyzing each frame to extract frequency components further includes determining a phase of a fundamental frequency by integrating an instantaneous pitch frequency, and defining the phases of the frequency components as multiples of the phase of the fundamental frequency.

7. A method of coding speech for digital transmission, the method comprising:

sampling the speech to obtain a series of discrete samples and constructing therefrom a series of frames, each frame spanning a plurality of samples;

analyzing each frame of samples to extract a set of variable frequency components having individual amplitudes and phases;

estimating the pitch for each frame of samples;

constructing a spectral envelope from the amplitudes of the frequency components;

sampling the envelope based upon the pitch estimate to obtain a set of amplitude values at variable channel frequencies, the location of which vary with the pitch;

coding the amplitude values for digital transmission; and synthesizing a set of reconstruction frequency components from the encoded values.

8. The method of claim 7 wherein the step of coding the amplitude values further includes defining a set of linearly-spaced channels in a baseband and a set of logarithmically-shaped channels in a higher frequency region.

9. The method of claim 8 wherein the step of defining said linear and logarithmatically-spaced channels further includes defining a transition frequency from said linearly-spaced frequency channels to said logarithmatically-spaced frequency channels based on a pitch measurement of the speech.

10. A speech coding device comprising:

sampling means for sampling a speech waveform to obtain a series of discrete samples and constructing therefrom a series of frames, each frame spanning a plurality of samples;

analyzing means for analyzing each frame of samples by Fourier analysis to extract a set of variable frequency components having individual amplitude and phase values;

estimating means for estimating the pitch for each frame of samples;

coding means for coding data representative of the analyzed speech frame and a pitch for each frame;

synthesizing means for synthesizing a set of reconstruction frequency components from the encoded data; and means for establishing a pitch onset time at which the frequency components come into phase synchrony.

11. The device of claim 10 wherein the analyzing means further includes a pitch onset estimator for establishing a time at which the frequency components come into phase.

12. The device of claim 10 wherein the analyzing means further includes a homomorphic phase estimator for estimating the phases of the frequency components and the coding means further includes means for coding only phase residuals for transmission.

13. The device of claim 10 wherein the coding means further includes a quadratic phase dispersion computer which eliminates the need to code phase values for the frequency components.

14. The device of claim 10 wherein the coding means further includes a random phase generator for generating a voicing dependent random phase for the frequency components.

15. The device of claim 10 wherein the analyzing means further includes means for determining the phase of a fundamental frequency by integrating an instantaneous pitch frequency and means for defining a series of onset times.

16. A speech coding device comprising:

sampling means for sampling a speech waveform to obtain a series of discrete samples and constructing therefrom a series of frames, each frame spanning a plurality of samples;

analyzing means for analyzing each frame of samples by Fourier analysis to extract a set of variable frequency components having individual amplitude and phase values;

estimating means for estimating the pitch of the waveform;

envelope construction means for constructing a spectral envelope from the amplitudes of the frequency components;

envelope sampling means for sampling the envelope based upon the pitch estimate to obtain a set of amplitude values at variable channel frequencies, the number and spacing of which vary based upon the pitch;

coding means for coding the amplitude values for digital transmission; and synthesizing means for synthesizing a set of reconstruction frequency components from the encoded values.

17. The device of claim 16 wherein the coding means further includes means for defining a first set of linearly-spaced frequency channels in a baseband, and a second set of logarithmatically-spaced channels in a higher frequency region.

18. The device of claim 17 wherein the coding means further includes means for defining a transition frequency from said linearly-spaced channels to said logarithmatically-spaced channels.

19. A system for processing an acoustic waveform comprising:

analyzing means for decomposing the waveform into a set of sinusoidal components having individual amplitudes which in sum approximate the waveform over an analysis frame;

pitch estimating means for estimating the pitch of the waveform for the analysis frame; and synthesis means for generating a synthetic reproduction of the waveform from the data representative of the analyzed waveform and the pitch, including means for summing a set of sinusoidal reconstruction components and means for establishing a pitch onset time for each analysis frame at which time the phases of the sinusoidal reconstruction components come into synchrony.

20. The system of claim 19 wherein the waveform is a speech waveform.

21. The system of claim 19 wherein the analysis means further comprises means for analyzing the waveform by Fourier analysis.

22. The system of claim 19 wherein the system further comprises means for modifying the time scale of the synthetic reproduction of the waveform.

23. The system of claim 19 wherein the system further comprises means for coding and transmitting the data representative of the analyzed waveform and the pitch.

* * * * *